US008251710B2

(12) United States Patent
Chen

(10) Patent No.: US 8,251,710 B2
(45) Date of Patent: Aug. 28, 2012

(54) LAMP SOCKET HAVING BOARD SUPPORTING MEANS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/983,322

(22) Filed: Jan. 2, 2011

(65) Prior Publication Data

US 2011/0306220 A1 Dec. 15, 2011

(30) Foreign Application Priority Data

Jun. 14, 2010 (CN) ..... 2010 2 0226337

(51) Int. Cl.
*H01R 12/00* (2006.01)

(52) U.S. Cl. ..... 439/56; 439/366; 439/232

(58) Field of Classification Search ..... 439/56, 439/57, 366, 375, 620.02, 226, 232, 233, 439/239, 240, 241, 242, 243, 336; 362/631
See application file for complete search history.

(56) References Cited

U.S. PATENT DOCUMENTS

| | | | | |
|---|---|---|---|---|
| 5,720,625 | A * | 2/1998 | Albeck et al. | 439/395 |
| 7,344,397 | B2 * | 3/2008 | Miyazono | 439/232 |
| 7,473,117 | B2 * | 1/2009 | Miyazono et al. | 439/239 |
| 7,503,786 | B2 * | 3/2009 | Kato et al. | 439/239 |
| 7,527,510 | B2 * | 5/2009 | Yoo | 439/232 |
| 7,530,828 | B2 * | 5/2009 | Miyazono | 439/232 |
| 7,530,829 | B2 * | 5/2009 | Yuan et al. | 439/232 |
| 7,549,880 | B2 * | 6/2009 | Miyazono et al. | 439/232 |
| 7,553,176 | B2 * | 6/2009 | Naito et al. | 439/239 |
| 7,591,695 | B2 * | 9/2009 | Handa et al. | 439/856 |
| 7,604,494 | B2 * | 10/2009 | Cho et al. | 439/232 |
| 7,607,805 | B2 * | 10/2009 | Kwon et al. | 362/378 |
| 7,637,625 | B2 * | 12/2009 | Kwon et al. | 362/97.2 |
| 7,637,765 | B2 * | 12/2009 | Chang et al. | 439/336 |
| 7,651,354 | B2 * | 1/2010 | Kim | 439/226 |
| 7,674,006 | B2 * | 3/2010 | Lee | 362/225 |
| 7,699,496 | B2 * | 4/2010 | Miyazono | 362/217.01 |
| 7,771,106 | B2 * | 8/2010 | Yang et al. | 362/634 |
| 7,806,709 | B2 * | 10/2010 | Yang et al. | 439/232 |
| 7,862,191 | B2 * | 1/2011 | Park et al. | 362/97.1 |
| 7,883,231 | B2 * | 2/2011 | Cho et al. | 362/97.1 |
| 7,896,673 | B2 * | 3/2011 | Kim | 439/226 |
| 7,926,965 | B2 * | 4/2011 | Cho et al. | 362/97.1 |
| 7,942,685 | B2 * | 5/2011 | Cho et al. | 439/239 |
| 7,950,823 | B2 * | 5/2011 | Kwon et al. | 362/225 |
| 8,007,326 | B2 * | 8/2011 | Urano | 439/750 |
| 8,061,862 | B2 * | 11/2011 | Cho et al. | 362/97.1 |
| 8,079,858 | B2 * | 12/2011 | Naito | 439/222 |
| 8,079,859 | B2 * | 12/2011 | Kim et al. | 439/226 |
| 8,087,947 | B2 * | 1/2012 | Urano | 439/232 |
| 2006/0279957 | A1 * | 12/2006 | Kwon et al. | 362/378 |

(Continued)

*Primary Examiner* — Ross Gushi
(74) *Attorney, Agent, or Firm* — Wei Te Chung; Andrew C. Cheng; Ming Chieh Chang

(57) ABSTRACT

A lamp socket includes an insulative housing defining a base, a lamp receiving portion extending upward form the base with a lamp receiving cavity, a board receiving portion extending downward from the base with a board receiving cavity and a side opening communicating with the board receiving cavity. A contact includes an engaging portion retained in the base, a clamp arm extending upward from the retaining portion and received in the board receiving cavity for contacting with a lamp and an contacting arm extending downward from the retaining portion and protruded in the board receiving cavity; A bottom cover is associated with the board receiving portion and defines a supporting arm protruded upwards in the board receiving cavity.

13 Claims, 5 Drawing Sheets

U.S. PATENT DOCUMENTS

2007/0037427 A1* 2/2007 Miyazono ..... 439/232
2007/0046171 A1* 3/2007 Miyazono ..... 313/493
2007/0183149 A1* 8/2007 Ko et al. ..... 362/225
2007/0218735 A1* 9/2007 Miyazono et al. ..... 439/226
2007/0286629 A1* 12/2007 Kwon et al. ..... 399/69
2007/0298662 A1* 12/2007 Kim ..... 439/620.02
2008/0080182 A1* 4/2008 Yang et al. ..... 362/249
2008/0102711 A1* 5/2008 Yang et al. ..... 439/660
2008/0106900 A1* 5/2008 Chang et al. ..... 362/249
2008/0119092 A1* 5/2008 Naito et al. ..... 439/873
2008/0124950 A1* 5/2008 Yuan et al. ..... 439/56
2008/0143917 A1* 6/2008 Yang et al. ..... 349/58
2008/0160816 A1* 7/2008 Cho et al. ..... 439/336
2008/0207063 A1* 8/2008 Handa et al. ..... 439/856
2009/0128734 A1* 5/2009 Cho et al. ..... 349/61
2009/0191741 A1* 7/2009 Cho et al. ..... 439/232
2009/0209126 A1* 8/2009 Takata et al. ..... 439/366
2010/0002419 A1* 1/2010 Naito ..... 362/97.1
2010/0039572 A1* 2/2010 Takata et al. ..... 348/794
2010/0091481 A1* 4/2010 Takata et al. ..... 362/97.1
2011/0306220 A1* 12/2011 Chen ..... 439/56

* cited by examiner

LAMP SOCKET HAVING BOARD SUPPORTING MEANS

BACKGROUND OF THE INVENTION

1. Field of the Invention

The present invention relates to a lamp socket, and more particularly, to lamp socket having a board supporting means.

2. Description of the Prior Art

A backlight assembly of a liquid crystal display (LCD) device, in general, is classified as either a direct illumination type backlight assembly or an edge illumination type backlight assembly, based on the location of the light source.

A conventional backlight assembly includes a cold cathode fluorescent lamp (CCFL) as the light source. A direct illumination type backlight assembly having a CCFL includes a lamp socket to fix lamps on a bottom plate of a receiving container. In order to easily fix the lamps to the bottom plate, lamp sockets have been developed on the bottom plate to secure an electrode portion of the lamp to the lamp sockets.

A conventional lamp socket disclosed in U.S. Pub. No. 2009/0128734 on May 21, 2009 includes a socket housing, a contact member and a socket cover. The contact member electrically connects an inverter with a lead wire of the lamp and a golden finger of a circuit board. In an assembly process for the lamp socket, the contact member is inserted into a hole formed in the socket housing, the lead wire is inserted into a terminal of the contact member, and the circuit board is contacted to an elastic end of the contact member. The socket cover is inserted into the socket body to fix the lead wire of the lamp to the lamp socket. As the elastic end only supports on one side of the circuit board in mating region, the circuit board would easily swing in the housing and increase the discontact probability.

Another lamp socket disclosed in U.S. Pub. No. 2008/0106900 on May 8, 2008 includes an improved contact member with an elastic end enclosed in a unitary frame, which can limit the move distance of the circuit board. US. Pub. No. 2007/0286629 on Dec. 13, 2007 also includes a lamp socket having a pair of elastic ends for holding a circuit board so that the contact stability of the lamp socket can be enhanced. However, both of the contact members in the prior arts have complicate manufacturing and assembling process.

In view of the above, an improved lamp socket that overcomes the above-mentioned disadvantages is desired.

SUMMARY OF THE INVENTION

Accordingly, an object of the present invention is to provide a lamp socket which has improved contact and housing structure.

To fulfill the above-mentioned object, A lamp socket includes an insulative housing defining a base, a lamp receiving portion extending upward form the base with a lamp receiving cavity, a board receiving portion extending downward from the base with a board receiving cavity and a side opening communicating with the board receiving cavity. A contact includes an engaging portion retained in the base, a clamp arm extending upward from the retaining portion and received in the board receiving cavity for contacting with a lamp and an contacting arm extending downward from the retaining portion and protruded in the board receiving cavity; A bottom cover is associated with the board receiving portion and defines a supporting arm protruded upwards in the board receiving cavity.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
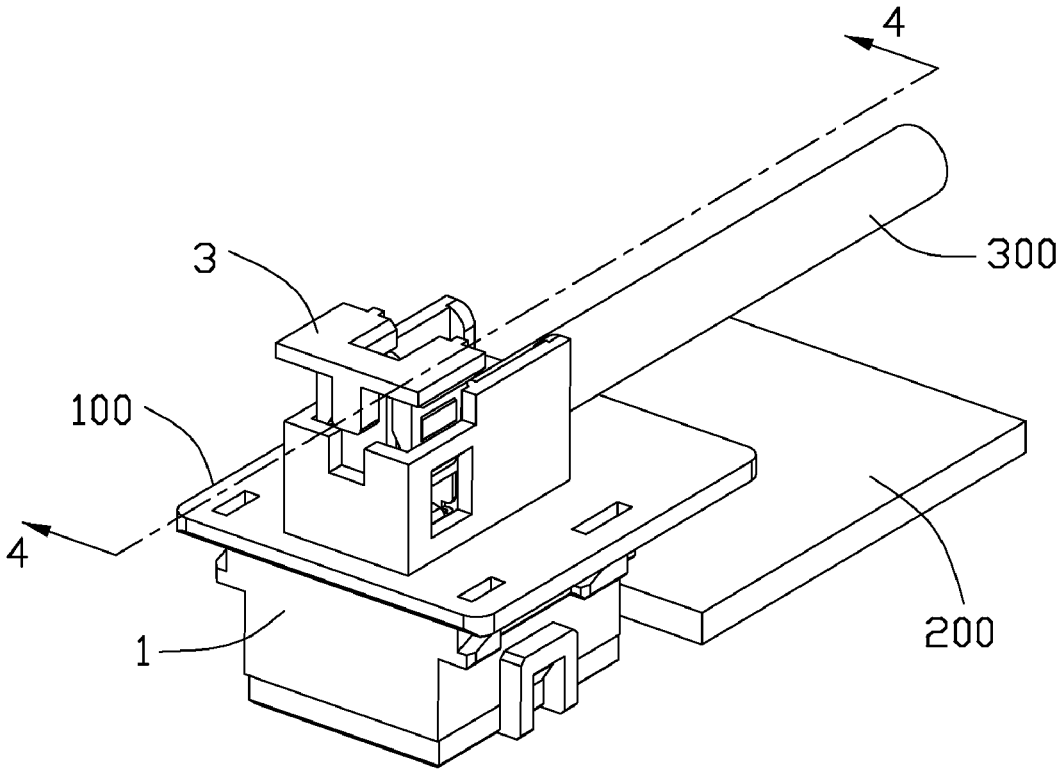
FIG. 1 is an assembled view of a lamp socket assembly including a lamp socket, a lamp and a circuit board of an embodiment of the present invention.

Reference will now be made to the drawings to describe the present invention in detail.

Referring to FIGS. 1-4, a lamp socket 100 in accordance with the embodiment of the present invention is inserted with a circuit board 200 and a lamp 300, which comprises an insulative housing 1, a contact 2 received in the housing 1, a top cover 3 inserted into the housing 1 to fix a lead wire of the lamp 300 to the lamp socket 100 and a board shaped under cover 4 assembled to the bottom of the insulative housing 1.

Figure 2:
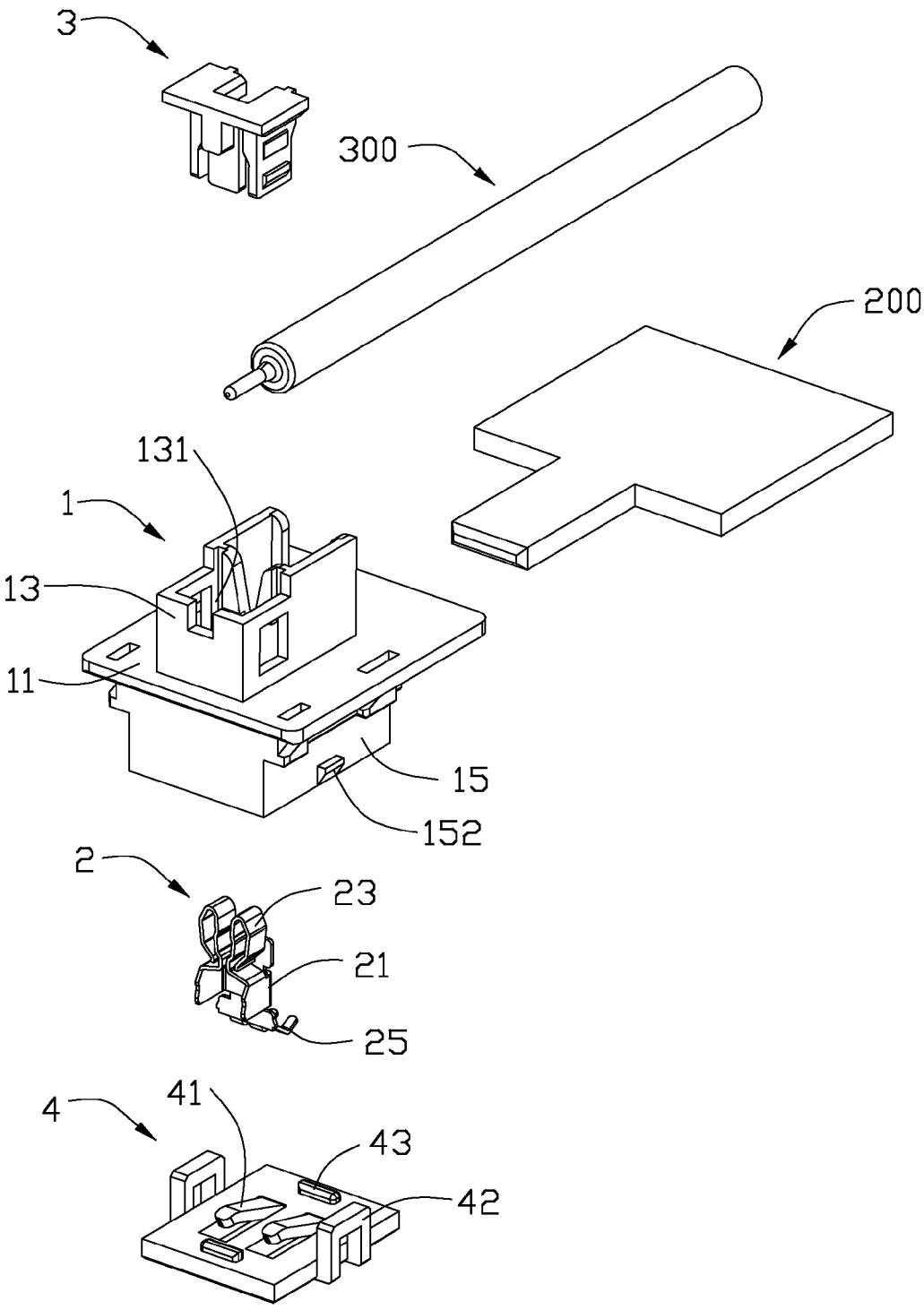
FIG. 2 is an exploded view of the lamp socket assembly in FIG. 1.
Figure 3:
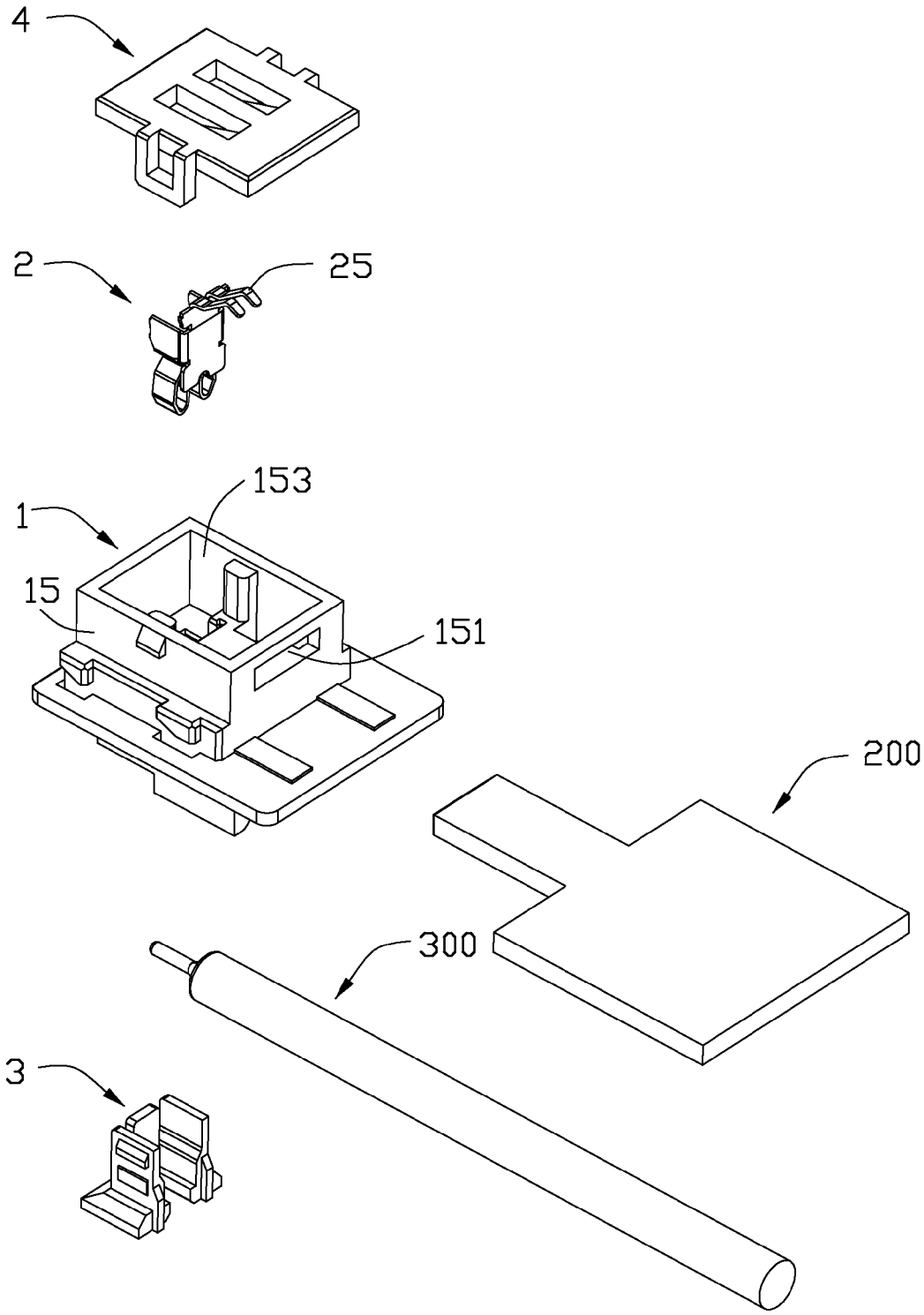
FIG. 3 is another exploded view of the lamp socket assembly in FIG. 1.

As best shown in FIGS. 2-3, the insulative housing 1 comprises a board base 11, a lamp receiving portion 13 extending upward form the base 11 with a top opening lamp receiving cavity 131 and a board receiving portion 15 extending downward form the base 11 with a bottom opening board receiving cavity 153 and a side opening 151 communicating with the bottom opening cavity 153 and an exterior. Combination with FIG. 4, the contact 2 comprises an engaging portion 21 engaged in the base 11 fitly, a pair of clamp arms 23 extending upward form the engaging portion 21 and received in the top opening cavity 131 for clip the lead wire of the lamp 300 and a pair of contacting arms 25 extending downward from the engaging portion 21 and protruded into the bottom opening cavity 153. A circuit board 200 is provided for being inserted into the bottom opening cavity 153 through the side opening 151 along an inserting direction B and electrically connects with the elastic arms 25 of the contact 2.

The board shaped cover 4 is attached on the bottom of board receiving portion 15 to shield the bottom opening cavity 153. The cover 4 defines a pair of latching portions 42 locked in the projections 152 on a periphery of the board receiving portion to retain the cover on the housing, and two supporting arms 41 slantwise protruded into bottom opening cavity 151 which is just press against a first surface of the circuit board opposite to a second face against which the contacting arms 25 of the contact press so as to s stably connect the circuit board and the contacting arm 25.

Figure 4:
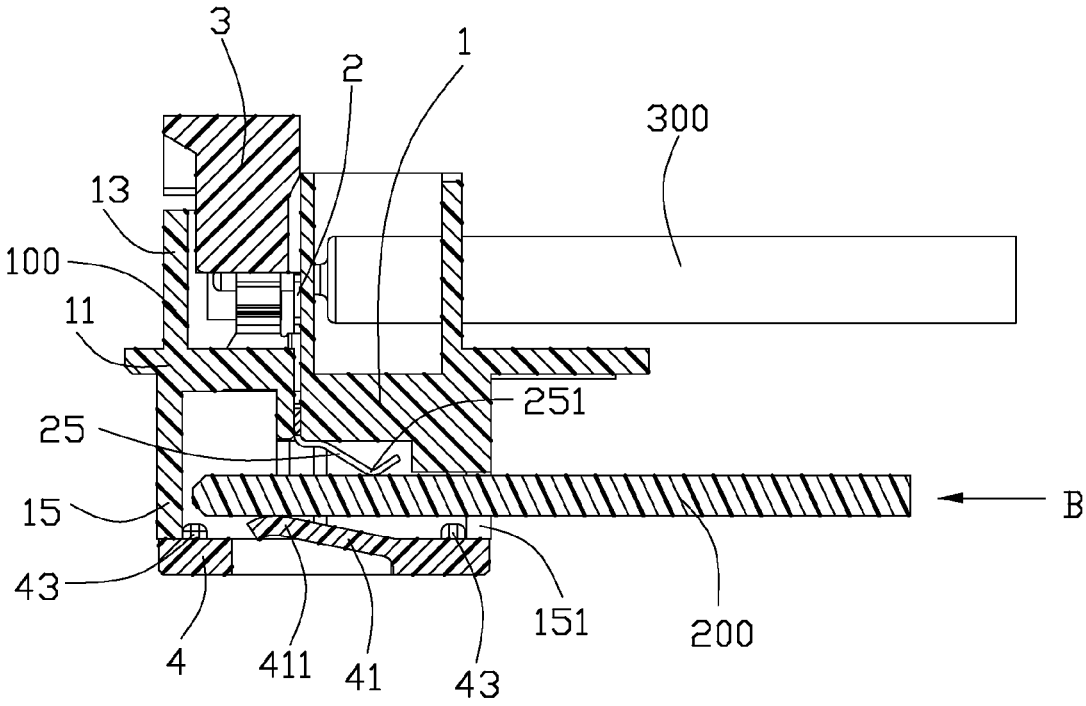
FIG. 4 is a cross sectional view along a line 4-4 in FIG. 1.

As best shown in FIG. 4, the contacting arms 25 extend slantwise downward and forwards (opposite to the inserting direction B) with a contacting point 251 facing downwards. The supporting arms 41 extend slantwise upward and rearwards (along the inserted direction B) with a pressing point 411. The supporting arms 41 and the elastic end 25 are sett offset along the inserting direction B and can be deformed oppositely by the inserted circuit board in the bottom opening which can reduce the move distance of the contacting arms 25 and the discontact probability to make stable contacts. The contacting point 251 of the contacting arms 25 is closer to the side opening 151 along the inserting direction B than that of the pressing points 411 of the supporting arms 41. In this way, the circuit board 200 will be raised up by the supporting arms 41 and make contact with the contacting arms 25 of the contact 2 gently in the mean time so as to optimize the guidance of the board inserted process. Two protrusions 43 are respectively formed on a front and a rear end of the cover 4 along the direction B to protect the supporting arms 41 and to limit the swing movement of the circuit board 200.

Figure 5:
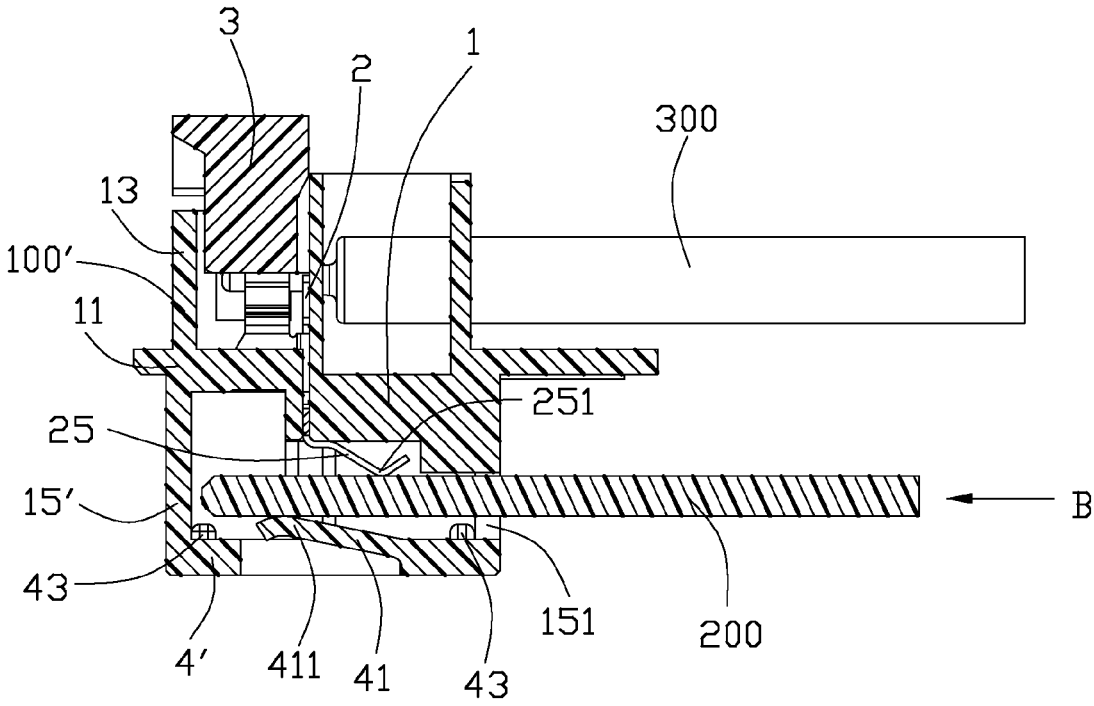
FIG. 5 is a cross sectional view similar to FIG. 4 to show a second embodiment of the present invention.

Combine with the preceding paragraph, another exemplary embodiment is simply described in FIG. 5. Different from the separate cover that was assembled to the bottom opening of the housing in above embodiment, this lamp socket 100' defines a unitary bottom wall 4' on bottom of a board receiving portion 15'. Corresponding supporting arms 41' and the protrusions 43' are formed on the bottom wall 4' with same structure as the cover 4 before. This also can reduce the move distance of the contact and the discontact probability to make stable contacts and any other advantages.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp socket comprising:

an insulative housing comprising a base, a lamp receiving portion extending upward form the base with a lamp receiving cavity, and a board receiving portion extending downward from the base with a board receiving cavity and a side opening communicating with the board receiving cavity;

a contact comprising an engaging portion retained in the base, a clamp arm extending upward from the retaining portion and received in the lamp receiving cavity for contacting with a lamp and an contacting arm extending downward from the retaining portion and protruded in the board receiving cavity;

wherein a bottom cover is associated with the board receiving portion and defines a supporting arm protruded upwards in the board receiving cavity.

2. The lamp socket as claimed in claim 1, wherein the contacting arm extends slantwise towards to the side opening and defines a contacting point facing downwards, the supporting arms extends slantwise away from the side opening and defines a pressing point facing upwards.

3. The lamp socket as claimed in claim 2, wherein the contacting point and the pressing point are offset from each other related to the side opening.

4. The lamp socket as claimed in claim 3, wherein the board receiving cavity is in a bottom opening form and the cover is attached to shield the bottom opening of the board receiving cavity.

5. The lamp socket as claimed in claim 4, wherein the contact is assembled to the housing through the bottom opening.

6. The lamp socket as claimed in claim 5, wherein the cover defines a pair of latching portions at two sides of the supporting arm to be locked with projections defined on the insulating housing.

7. The lamp socket as claimed in claim 4, wherein two protrusions are respectively formed on two opposite ends of the supporting arm along a direction the supporting means extends.

8. A lamp socket comprising:

an insulative housing comprising a lamp receiving portion with a lamp receiving cavity and a board receiving portion with a board receiving cavity and a side opening communicating with the board receiving cavity;

a contact retained in the insulative housing and comprising a clamp arm extending in the lamp receiving cavity for clamping a wire lead of the lamp contained in the lamp receiving cavity and a contacting arm extending in the board receiving cavity for touching with a first surface of a circuit board which is inserted in the board receiving cavity through the side opening; wherein a supporting means is provided to press against a second surface opposite to the first surface of the circuit board, wherein the supporting means and the contacting arm press against the circuit board in an offset fashion, the contacting arm slant towards the side opening and defines a contacting point, the supporting means slant away the side opening and defines a pressing point, the contacting point and the pressing point facing in opposite directions, wherein the contacting point and the pressing point are offset from each other in a perpendicular direction to said opposite directions, wherein two protrusions are respectively formed on two opposite ends of the supporting means along a direction the supporting means extends.

9. A lamp socket assembly comprising:

an insulative housing assembly defining a base with opposite first and second sides thereof and with a lamp receiving portion on the first side of the base and a board receiving portion on the second side of the base;

a contact fixed to the housing and including a clamp arm upwardly extending into the lamp receiving portion to mechanically and electrically connected to a lamp, and a resilient contact arm extending downward into the board receiving portion to mechanically and electrically connected to a first surface of printed circuit board; wherein the housing assembly further defines a spring arm applying a resilient force upon a second surface of the printed circuit board which is opposite to the first surface so as to have the printed circuit board in a resiliently balanced manner.

10. The lamp socket assembly as claimed in claim 9, wherein the spring arm and the resilient contact arm press against the circuit board in an offset fashion, the resilient contact slant towards the side opening and defines a contacting point, the spring arm slant away the side opening and defines a pressing point, the contacting point and the pressing point facing in opposite directions.

11. The lamp socket assembly as claimed in claim 9, wherein said housing assembly include a cover on which said spring arm is formed.

12. The lamp socket assembly as claimed in claim 11, wherein the contacting point and the pressing point are offset from each other in a perpendicular direction to said opposite directions.

13. The lamp socket assembly as claimed in claim 11, wherein two protrusions are respectively formed on two opposite ends of the spring arm along a direction the spring arm extends.

* * * * *